US007669428B2

(12) United States Patent
Federov et al.

(10) Patent No.: US 7,669,428 B2
(45) Date of Patent: Mar. 2, 2010

(54) VORTEX TUBE REFRIGERATION SYSTEMS AND METHODS

(75) Inventors: Andrei G. Federov, Atlanta, GA (US); Robert Wadell, Atlanta, GA (US); Stephane Launay, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 1129 days.

(21) Appl. No.: 11/105,833

(22) Filed: Apr. 14, 2005

(65) Prior Publication Data

US 2006/0230765 A1 Oct. 19, 2006

(51) Int. Cl.
*F25B 9/02* (2006.01)

(52) U.S. Cl. ..... 62/5; 62/238.2

(58) Field of Classification Search ..... 62/5, 62/6, 602, 332, 498, 238.2
See application file for complete search history.

(56) References Cited

U.S. PATENT DOCUMENTS

| | | | | |
|---|---|---|---|---|
| 4,584,838 | A * | 4/1986 | AbuJudom, II | 62/5 |
| 5,327,728 | A | 7/1994 | Tunkel | 62/5 |
| 5,572,872 | A | 11/1996 | Hlavacek | 62/3.6 |
| 5,966,942 | A | 10/1999 | Mitchell | 62/6 |
| 6,125,692 | A | 10/2000 | Marmonier | 73/40 |
| 6,250,086 | B1 | 6/2001 | Cho et al. | 62/5 |
| 6,389,818 | B2 * | 5/2002 | Cho et al. | 62/5 |
| 6,401,463 | B1 | 6/2002 | Dukhan et al. | 62/5 |
| 6,425,249 | B1 * | 7/2002 | Cho et al. | 62/5 |
| 6,430,937 | B2 | 8/2002 | Cho et al. | 62/5 |
| 6,634,870 | B2 | 10/2003 | Dreiman et al. | 417/368 |
| 6,651,451 | B2 * | 11/2003 | Cho et al. | 62/197 |
| 6,662,576 | B1 | 12/2003 | Bai | 62/117 |
| 6,958,107 | B1 | 10/2005 | Clarke et al. | 159/2.1 |
| 6,962,199 | B1 | 11/2005 | Tjeenk Willink | 166/265 |
| 6,990,817 | B1 | 1/2006 | Bhatia | 62/5 |
| 2001/0042380 | A1 * | 11/2001 | Cho et al. | 62/238.2 |
| 2003/0196445 | A1 * | 10/2003 | Cho et al. | 62/197 |

* cited by examiner

*Primary Examiner*—Melvin Jones
(74) *Attorney, Agent, or Firm*—Thomas, Kayden, Horstemeyer & Risley, LLP

(57) ABSTRACT

Briefly described, embodiments of this disclosure, among others, include vortex vapor compression refrigeration (VCR) systems and methods of cooling.

34 Claims, 5 Drawing Sheets

VORTEX TUBE REFRIGERATION SYSTEMS AND METHODS

FIELD OF THE DISCLOSURE

The present disclosure relates generally to refrigeration systems and methods.

BACKGROUND

FIG. 1 illustrates a conventional refrigeration system 10 (refrigeration cycle) for both sub-critical and transcritical refrigeration cycles. The refrigeration system 10 includes a throttle valve 14, an evaporator 16, a compressor 18, and a condenser (for sub-critical cycle) or gas cooler (for transcritical cycle) 22, all of which are in fluid communication with one another via a manifold 12. The refrigeration system 10 includes a working fluid that flows through the system and is used to remove thermal energy from the evaporator 16. FIG. 2 illustrates a thermodynamic diagram (cycle) for the conventional refrigeration system shown in FIG. 1, where the cycle positions/states (e.g., "a", "b", "c", and "d") corresponds to the schematic in FIG. 1. The cycle is a transcritical cycle because all states of the cycle are in the vicinity of the critical point of the working substance (e.g., $CO_2$) with the throttling process proceeding from the supercritical pressure ($P_a>P_{critical}$) to sub-critical pressure ($P_b<P_{critical}$) at constant enthalpy in the vicinity of the critical enthalpy ($h_a=h_b=h_{throttle}\sim h_{critical}$).

In an ideal (reversible) case, the conventional transcritical refrigeration system operates in the following way. From position "a" to position "b" is an isoenthalpic (constant enthalpy $h=\text{constant}\sim h_{critical}$) throttling process from the supercritical fluid ($P_a>P_{critical}$) state "a" to the sub-critical ($P_b<P_{critical}$) liquid/vapor mixture state "b".

From position "b" to position "c" is an isobaric (constant pressure $P_b=P_c=\text{constant}<P_{critical}$) evaporation (phase change) process from the liquid/vapor mixture state "b" to the saturated (or possibly slightly superheated) vapor state "c". During this process, heat is being absorbed by the working fluid in an evaporator to enable refrigeration.

From position "c" to position "d" is a compression process (in an idealized reversible case, isoentropically) from the saturated (or possibly slightly superheated) vapor state "c" at lower pressure $P_c$ to the higher pressure $P_d$ superheated vapor state "d", which is also in the supercritical fluid domain.

From position "d" to position "a" is an isobaric (constant pressure $P_d=P_a=\text{constant}>P_{critical}$) cooling of the working substance from the supercritical fluid state "d" with higher enthalpy ($h_d$) to another supercritical fluid state "a" with lower enthalpy ($h_a$). During this process, heat is being rejected to the atmosphere in the gas cooler.

Early in the $20^{th}$ century, carbon dioxide was introduced and became popular as a refrigerant fluid (working fluid) because of its low toxicity, non-flammability, low cost, and universal availability. The use of competing refrigerants such as ammonia, sulfur dioxide, methylene chloride, and others, achieved much higher cycle efficiencies (i.e., coefficient of performance (COP)), but the applications were limited because of various other shortcomings. The use of $CO_2$ as a refrigerant declined dramatically in the early 1930s, with development of chlorofluorocarbons (CFC) featuring low toxicity, as well as high COP of the refrigeration cycle.

Recently, the interest in carbon dioxide based refrigeration has picked up again, and quite sharply, owing to the ban on the use of CFCs and the phaseout of hydro-CFC (HCFC) due to serious environmental problems. Despite its unique advantages (e.g., low toxicity, non-flammability, low cost, environmental friendliness, and universal availability), low cycle efficiency is the major factor that prevents widespread application of $CO_2$ refrigeration technology. This is an equally valid point for both a conventional vapor-compression cycle, as well as more recent supercritical/transcritical refrigeration cycles (critical temperature $T_{critical}=31.1°$ C. for carbon dioxide). For example, according to an ASHRAE Handbook (p. 167, 1993), the $CO_2$ refrigeration cycle with an evaporating temperature of −15° C. and a condensing temperature of 30° C. has coefficient of performance (COP) of only 2.81, as compared to 4.77 for ammonia, 4.67 for R-22, and 4.41 for R-134a.

Therefore, there is a need in the industry to develop technology to overcome at least some of the deficiencies and inadequacies described above.

SUMMARY

Briefly described, embodiments of this disclosure, among others, include vortex vapor compression refrigeration (VCR) systems and methods of cooling. One exemplary vortex VCR system, among others, includes an "n" number of a vortex tube, an evaporator, a condenser, "n+1" number of a compressor, and a working fluid. Here, "n" is a positive integer greater or equal to 1. The vortex tube(s), the evaporator, the condenser, and the compressor(s), are in fluid communication with one another via a manifold. The vortex tube has a first end and a second end. The vortex tube is configured to separate the working fluid into a first working fluid stream and a second working fluid stream. The vortex tube is configured to direct the first working fluid stream out of the first end of the vortex tube. The vortex tube is configured to direct the second working fluid stream out of the second end of the vortex tube, wherein the first working fluid stream has a lower enthalpy than the second working fluid stream.

Another exemplary vortex VCR system, among others, includes at least one vortex tube, an evaporator, a condenser, at least one compressor, a throttle, and a working fluid. The vortex tube, the evaporator, the condenser, the compressor, and the throttle are in fluid communication with one another via a manifold. The vortex tube has a first end and a second end. The vortex tube is configured to separate the working fluid into a first working fluid stream and a second working fluid stream. The vortex tube is configured to direct the first working fluid stream out of the first end of the vortex tube. The vortex tube is configured to direct the second working fluid stream out of the second end of the vortex tube. The manifold is configured to direct the first working fluid stream to the evaporator. The manifold is configured to direct the second working fluid away from the evaporator. The first working fluid stream has a lower enthalpy than the second working fluid stream. The working fluid comprises a $CO_2$ fluid.

One exemplary method of cooling, among others, includes: providing a vortex tube assisted vapor compression refrigeration (VCR) system comprising: "n" number of a vortex tube, an evaporator, a condenser, an "n+1" number of a compressor, and a working fluid, wherein the vortex tube, the evaporator, the condenser, and the compressor, are in fluid communication with one another via a manifold; flowing the working fluid into the vortex tube, wherein the working fluid is separated into a first working fluid stream and a second working fluid stream by the vortex tube, wherein the first working fluid has a lower enthalpy than the second working fluid; and flowing the first working fluid stream out of a first end of the vortex tube and flowing the second working fluid stream flows out of a second end of the vortex tube, wherein a coefficient of performance (COP) of the vortex VCR system is increased. Here, "n" is a positive integer greater or equal to 1.

Another exemplary method of cooling, among others, includes: providing a vortex tube assisted vapor compression refrigeration (VCR) system including a vortex tube, an evaporator, a condenser, at least one compressor, a throttle, and a working fluid, wherein the vortex tube, the evaporator, the condenser, the compressor, and the throttle are in fluid communication with one another via a manifold, wherein the first working fluid has a lower enthalpy than the second working fluid, and wherein the working fluid comprises a $CO_2$ fluid; flowing the working fluid into the vortex tube, wherein the working fluid is separated into a first working fluid stream and a second working fluid stream by the vortex tube; and flowing the first working fluid stream toward the evaporator and flowing the second working fluid stream away from the evaporator.

Other apparatuses, systems, methods, features, and advantages of this disclosure will be or become apparent to one with skill in the art upon examination of the following drawings and detailed description. It is intended that all such additional apparatuses, systems, methods, features, and advantages be included within this description, be within the scope of this disclosure, and be protected by the accompanying claims.

BRIEF DESCRIPTION OF THE DRAWINGS

Further aspects of the present disclosure will be more readily appreciated upon review of the detailed description of its various embodiments, described below, when taken in conjunction with the accompanying drawings.

DETAILED DESCRIPTION

Figure 1:
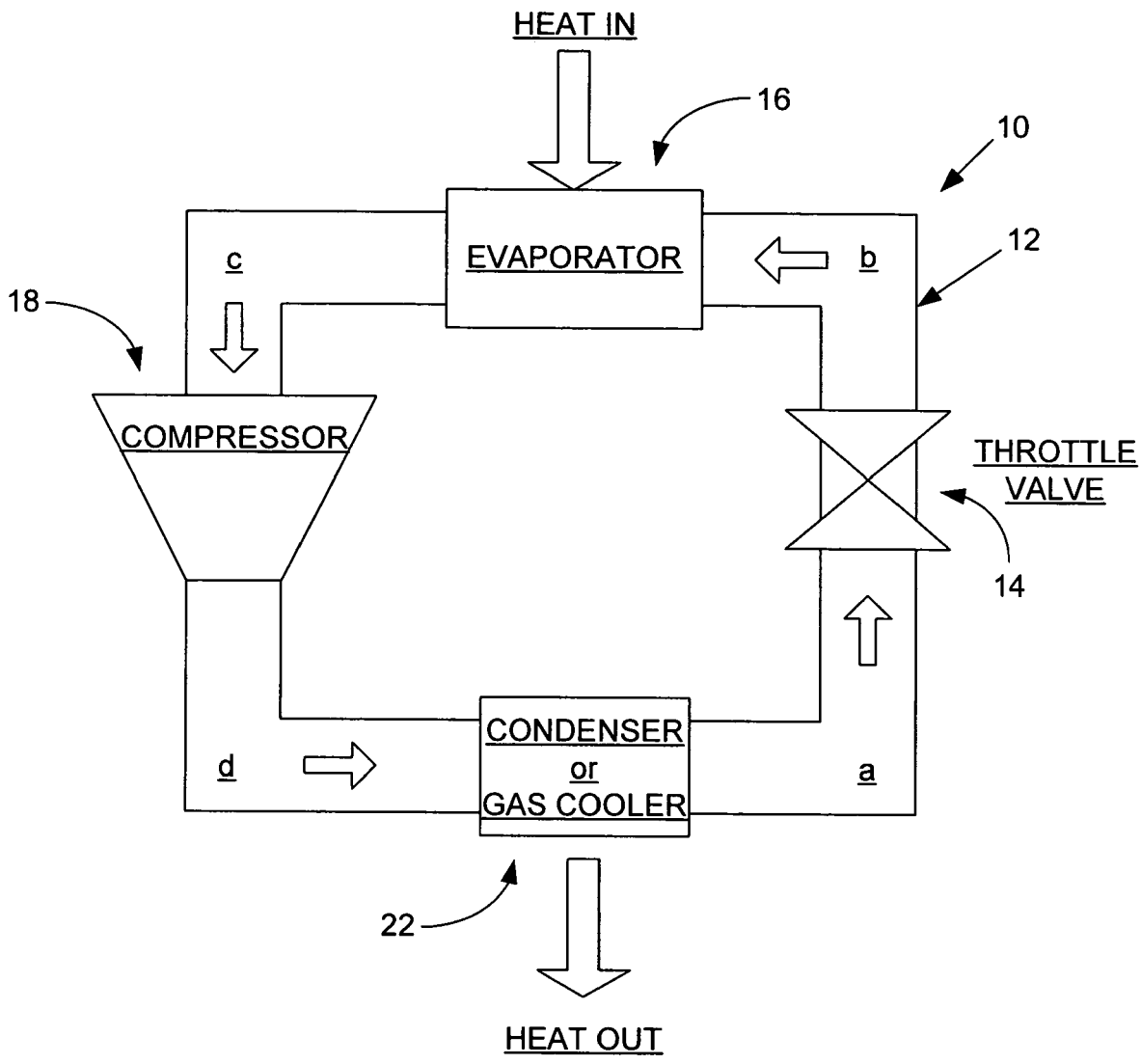
FIG. 1 PRIOR ART
FIG. 1 illustrates a conventional vapor compression refrigeration system.
Figure 2:
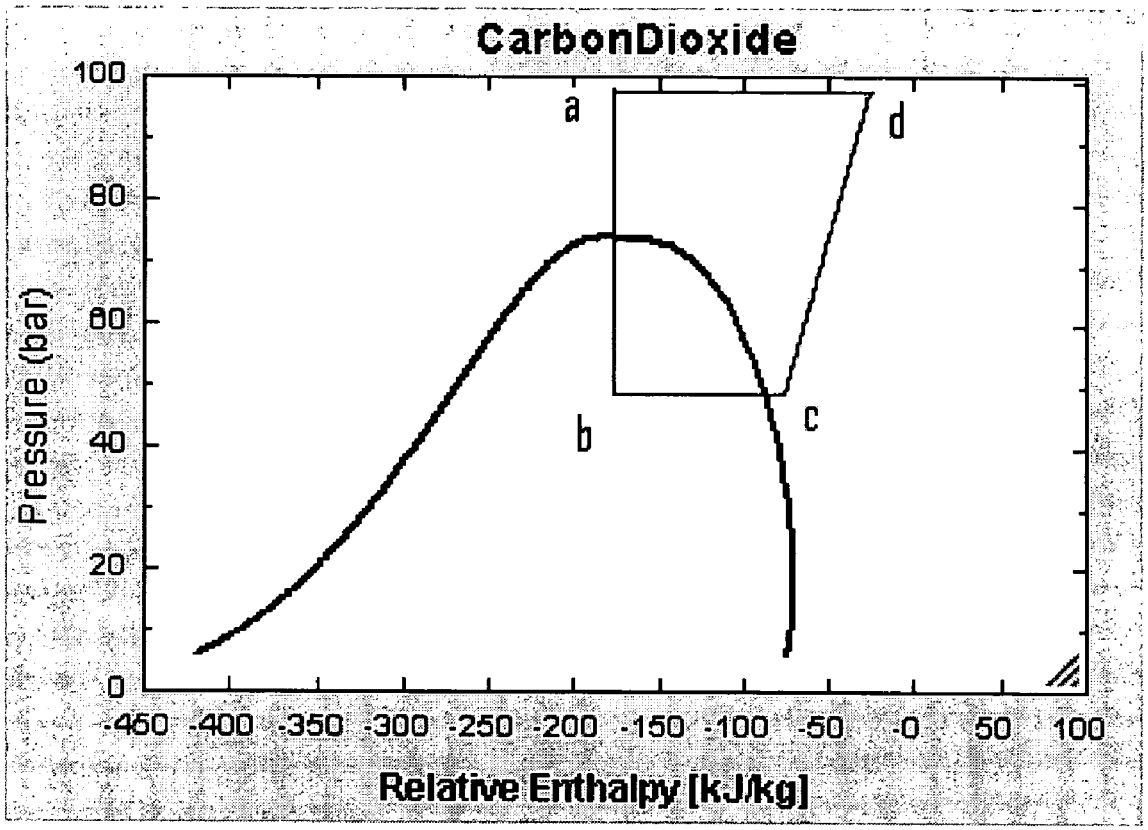
FIG. 2 PRIOR ART
FIG. 2 illustrates a thermodynamic diagram for the conventional transcritical vapor compression refrigeration system shown in FIG. 1.

Vortex tube assisted vapor compression refrigeration (Vortex VCR) systems and methods of use are disclosed herein. In general, the Vortex VCR system includes a vortex tube (an "n" number of the vortex tubes, where "n" is a positive integer greater or equal to 1) and a working fluid. The combination of the vortex tube and the working fluid allows for highly efficient and an environmentally friendly refrigeration technology to be developed. The Vortex VCR system features a high efficiency (as measured by the coefficient of performance) refrigeration system and uses an environmentally benign working fluid (e.g., $CO_2$). In contrast to most chlorofluorocarbons (CFC) used in current vapor compression refrigeration systems, the working fluid described in this disclosure has a low toxicity, is non-flammable, has a relatively low cost, and is universally availability. The Vortex VCR system using the vortex tube and a $CO_2$ working fluid may help in developing a sustainable energy generation and utilization infrastructure. Some embodiments of the Vortex VCR system can achieve a COP of about 4.5 or more when operated between 10° C. and 40° C. evaporator and condenser temperatures, respectively, which is comparable to presently used R-22 and R-134a based refrigeration cycles and not much less than the ideal COP for the Carnot reversible refrigeration cycle. It should be noted that unlike turbo-expanders, this performance enhancement is achieved without adding to the complexity of the system. The vortex tube is a simple, inexpensive device with no moving parts, and requires no special maintenance.

In general, the Vortex VCR system includes, but is not limited to, a "n" number of a vortex tube, an evaporator, a condenser or gas cooler (hereinafter, the term "condenser" is intended to include condensers and gas coolers that one skilled in the art would include the appropriate one in a particular system), an "n+1" number of a compressor, and a working fluid, where n can be any positive integer greater than 1 (e.g., from 1 to 20). In an embodiment, the Vortex VCR system includes a throttle. In addition, the Vortex VCR system can include other components such as pressure regulators, flow regulators, a storage tank, mixers, and other such components used in any refrigeration system or in a supercritical, transcritical, or liquefied gas system. The working fluid can include, but is not limited to $CO_2$, water vapor, ammonia, methane, hydrogen, chlorofluorocarbons, and mixtures of these and other refrigerants with suitable critical and triple points (depending on the range of operating temperatures, and combinations thereof). The Vortex VCR system can include multiple vortex tubes and compressors, in parallel and/or in series. In embodiments where "n" is greater than 1, the number of the vortex tubes and compressors can be selected to optimize the pressure drop across each vortex tube, which can be advantageous in some Vortex VCR systems. The terms evaporator, gas cooler or condenser, compressor, and throttle have their ordinary meaning as known in the refrigeration art.

The vortex tube, the evaporator, the condenser, the compressor, and the throttle are in fluid communication with one another via a manifold. The term "fluid communication" includes the ability to move or the movement of a fluid through the manifold among and/or through the various components. In particular, the working fluid can flow among the various components via the manifold. The working fluid can be diverted into two or more separate streams and can be re-combined from two or more separate streams into fewer than two or more streams.

The vortex tube separates the working fluid into a first working fluid stream and a second working fluid stream (the same working fluid, but at different temperatures), where the first working fluid stream exits a first end of the vortex tube, while the second working fluid exits the second end of the vortex tube. The first working fluid stream flows to the evaporator (e.g., directly or indirectly). For example, the first working fluid may first become pre-cooled by flowing through the throttling valve. The second working fluid stream flows away from the evaporator. Additional details regarding the proximity of the components are described in reference to FIG. 3. The first working fluid stream has a lower enthalpy than the second working fluid stream.

As mentioned above, the Vortex VCR system can be used to remove thermal energy in systems, devices, components, and the like. In this regard, the Vortex VCR system (e.g., the evaporator) thermally communicates with one or more systems, devices, components, and the like, that may need heat removed therefrom. The term "thermally communicate" includes the ability to move or the movement of thermal energy (e.g., heat) from one location to another location. In particular, the term thermally communicate includes the movement of heat from one or more systems, devices, components, and the like, to the evaporator. In particular, the heat is absorbed by the working fluid of the Vortex VCR system.

In an embodiment, the Vortex VCR system (e.g., the evaporator) thermally communicates with a semiconductor system, device, process, and/or structure, where the evaporator is able to remove heat from a semiconductor system, a device, a process, and/or a structure. Furthermore, the semiconductor system can include a computer chip, a package containing a computer chip, an infrared detector array, or other devices that generate heat in the course of operation that needs to be removed for proper functioning.

In another embodiment, the Vortex VCR system can be used to remove thermal energy in systems such as, but not limited to, a refrigerator system, a freezer system, a liquefaction system, and an air conditioning system. In particular, the Vortex VCR system can be used in conjunction with household refrigerators, commercial air conditioning systems, automotive air conditioning systems, portable air conditioning systems, commercial refrigerator systems, commercial freezer systems (e.g., supermarket freezers), and other systems that require or benefit from heat rejection (e.g., heat removal, heat exchanger, and the like) from the low temperature domain to the higher temperature environment.

The Vortex VCR system can have a coefficient of performance (COP) that is an improvement relative to other systems by at least an increase of about 10%, about 25%, about 50%, about 100%, about 200%, about 300%, about 400%, and about 500%. The absolute value of the COP can be a number between 0 and infinity with the maximum possible limit dictated by the Second Law of Thermodynamics (e.g., the Carnot COP which is defined in terms of the minimum $T_L$ and maximum $T_H$ temperatures of the cycle as follows $COP_{max}=COP_{carnot}=T_L/(T_H-T_L)$). The absolute value of the COP depends in part on the working fluid, the operating temperatures, the operating pressures, the number of vortex tubes, the number of compressors, and the like. The absolute value of the COP can vary greatly depending on at least these variables.

In an embodiment, the Vortex VCR system operating between 10° C. and 40° C. can have a coefficient of performance (COP) of greater than about 3.1, greater than about 3.2, greater than about 3.3, greater than about 3.5, greater than about 3.7, greater than about 3.9, greater than about 4.1, greater than about 4.2, greater than about 4.3, greater than about 4.4, and greater than about 4.5. In another embodiment, the VCR system operating between 10° C. and 40° C. can have a COP from about 3.2 to 4.5, about 3.3 to 4.5, about 3.5 to 4.5, about 3.7 to 4.5, about 3.9 to 4.5, about 4.1 to 4.5, about 4.2 to 4.5, and about 4.3 to 4.5.

Now having described the Vortex VCR system, the following non-limiting figures are provided to provide additional details regarding the Vortex VCR system.

Figure 3:
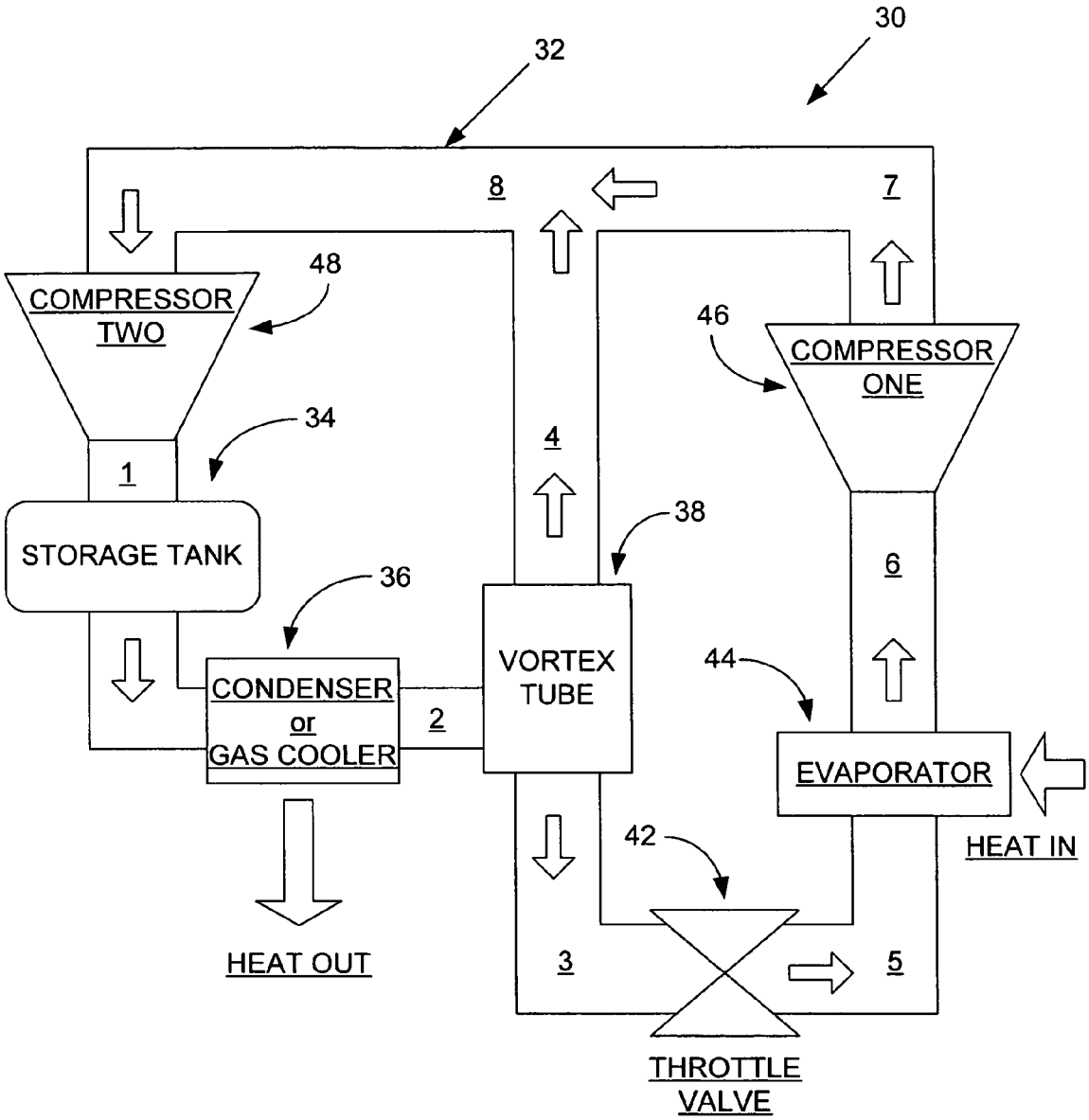
FIG. 3 is a schematic of a representative embodiment of a vortex tube assisted transcritical vapor compression refrigeration (vortex VCR) system.

FIG. 3 is a schematic of a representative embodiment of a Vortex VCR system 30. The Vortex VCR system 30 includes, but is not limited to, a storage tank 34, a gas cooler or condenser 36, a vortex tube 38, a throttle 42, an evaporator 44, compressor one 46, compressor two 48, and a working fluid (not shown). In another embodiment, the Vortex VCR system does not include a throttle. In addition, the Vortex VCR system 30 can include other components such as, but not limited to, pressure regulators, flow regulators, stream mixers, bypass lines, storage tank or accumulators, and the like, positioned at various portions of the manifold to achieve appropriate pressure, flow, and temperature levels. The storage tank 34, the condenser 36, the vortex tube 38, the throttle 42, the evaporator 44, the compressor one 46, and the compressor two 48, are in fluid communication with one another via a manifold 32. The relative position of each of the components is detailed in FIG. 3. As mentioned above, other embodiments can include "n" number of a vortex tube and "n+1" number of a compressor, where "n" is from 1 to 20.

In general the following is a description of the Vortex VCR system 30 and method of cooling (refrigeration cycle): starting from position "1" in FIG. 3, the working fluid flows into the gas cooler/condenser 36. At position "2" the working fluid flows into the vortex tube 38. As mentioned above, the working fluid is separated into a first working fluid stream and a second working fluid stream by the vortex tube 38. The first working fluid stream flows to the throttle 42 (position "3") and the second working fluid stream flows toward the compressor two 48 (position "4"). The first working fluid stream flows through the throttle where it is being cooled to position "5". From position "5" the first working fluid stream flows into the evaporator 44, where heat is removed from the evaporator 44. The first working fluid stream flows from position "6" into the compressor one 46. From position "7", the first working fluid stream flows to position "8", where the first working fluid stream and the second working fluid stream mix and flow to compressor two 48. The cycle starts again at the position "1".

Figure 4:
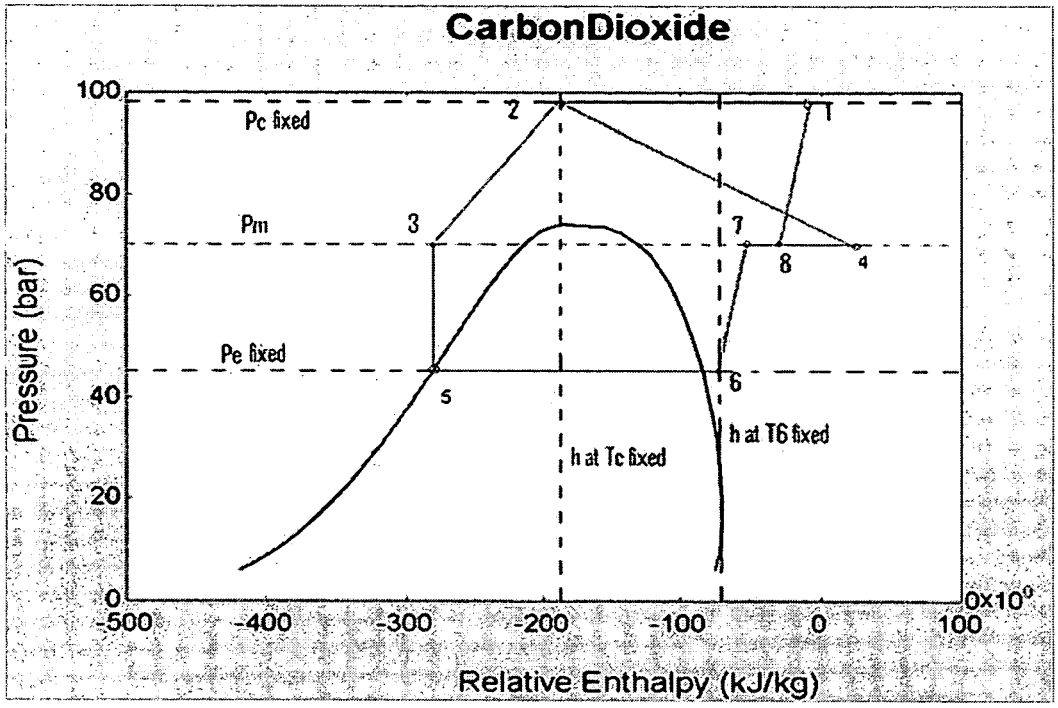
FIG. 4 illustrates a thermodynamic diagram for an exemplary vortex VCR system using $CO_2$, where the cycle positions (e.g., "1", "2" . . . "8") corresponds to the schematic in FIG. 3.

Having described the flow of the working fluid in general, the following paragraphs and FIG. 4 provide additional detail. FIG. 4 illustrates a transcritical thermodynamic diagram for an exemplary idealized (reversible) Vortex VCR system 30 using $CO_2$, where the cycle positions (e.g., "1", "2" . . . "8") corresponds to the schematic in FIG. 3. It should be noted that at position "1", the working fluid has a pressure ($P_1$), a temperature ($T_1$), and an enthalpy ($h_1$); at position "2", the working fluid has a pressure ($P_2$), a temperature ($T_2$), and an enthalpy ($h_2$); and so on for each position. The positions are also referenced as fluid, liquid, or gas states at those positions.

From position "1" to position "2" is isobaric (constant pressure $P_1=P_2=\text{constant}>P_{critical}$) cooling of the working fluid from the supercritical fluid state "1" with higher enthalpy ($h_1$) to another supercritical fluid state "2" with lower enthalpy ($h_2$). During this process, heat is being removed from the working fluid in a gas cooler/condenser of the Vortex VCR system 30.

Figure 6:
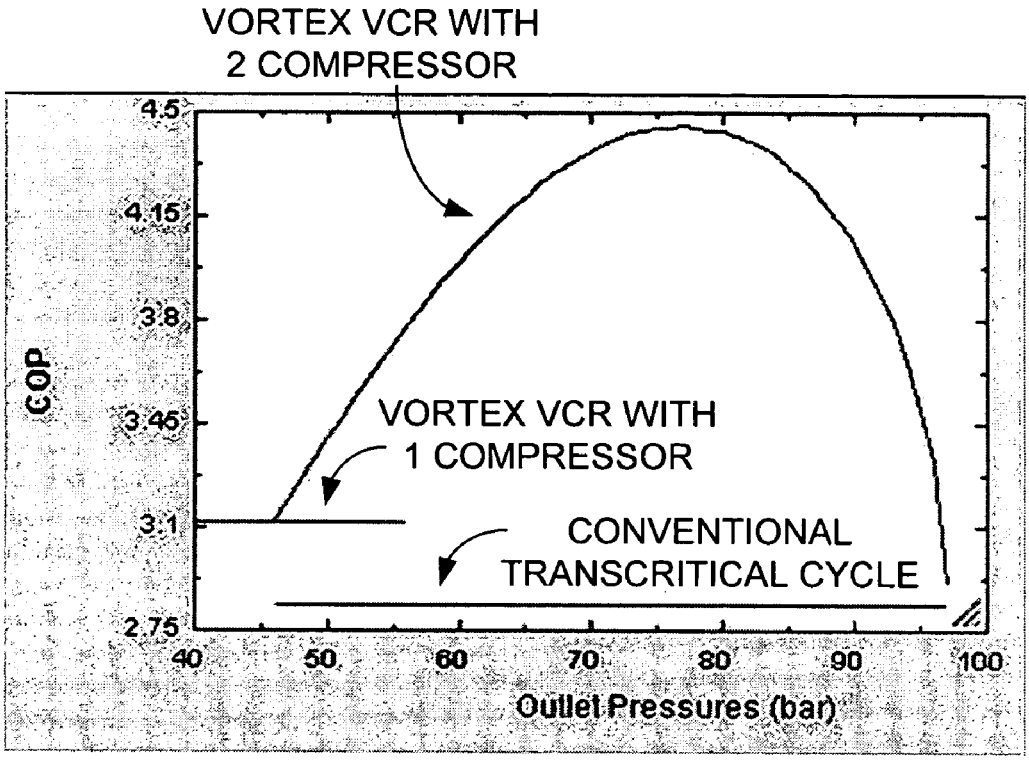
FIG. 6 illustrates the dependence of the coefficient of performance (COP) of the VCR system incorporating a vortex tube as a function of the outlet pressure ($P_3=P_m$) of the vortex tube.

From position "2" to position "3" to position "4" (Enthalpy/Mass Separation in the Vortex Tube): Supercritical working fluid with ($P_2>P_{critical}$; and $h_2\sim h_{critical}$) enters in the inlet of the vortex tube 38 and part of the stream leaves it as highly subcooled ($h_3<h_2\sim h_{critical}$) near-critical fluid ($P_3<P_2$ but $P_3\geqq P_{critical}$) or as a subcooled liquid or liquid/vapor mixture if a higher pressure drop is used in the vortex tube 38 (then, $h_3<h_{critical}$ & $P_3<P_{critical}$). At the other end of the vortex tube 38, the "hot" higher enthalpy ($h_4>h_2\sim h_{critical}$) stream leaves the vortex tube 38 either as a supercritical fluid (if $P_4<P_2$ but $P_4\geqq P_{critical}$) or as superheated vapor (if $P_4<P_2$ and $P_4<P_{critical}$). Clearly, the pressure drop in the vortex tube 38 (i.e., exit pressures $P_3$ and $P_4$, which are not necessarily equal to each other but may be so) can be optimized as illustrated in FIG. 6, to achieve maximum COP.

From position "3" to position "5": Isoenthalpic (constant enthalpy $h_3=h_5$) throttling process from the sub-cooled near-critical fluid state "3" ($P_3 \sim P_{critical}$) to the sub-critical ($P_5<P_3$) liquid/vapor mixture or even potentially saturated liquid state "5".

From position "5" to position "6": Isobaric (constant pressure $P_5=P_6=\text{constant}<P_{critical}$) evaporation (phase change) process from the liquid/vapor mixture (possibly even saturated liquid) state "5" to the saturated (or possibly slightly superheated) vapor state "6". During this process, heat is being absorbed by the working fluid in an evaporator to enable refrigeration.

From position "6" to position "7": Compression process in the first compressor 46 (in idealized reversible case, isoentropically) from the saturated (or possibly slightly superheated) vapor state "6" at lower pressure $P_6$ to the higher pressure $P_7$ superheated vapor state "7", which may also be in the transcritical or supercritical fluid domains depending on the pressure after the compressor $P_7$ which is equal to the pressure of the "hot" stream leaving the vortex tube 38 at the state "4" (i.e., $P_4=P_7$).

From positions "7" and "4 " to position "8": Isobaric (constant pressure $P_4=P_7=P_8$) mixing of the streams exiting the compressor (state "7") and the hot end of the vortex tube (state "4"). The resulting fluid is in supercritical or near-critical fluid or superheated vapor state (depending on the exact magnitude of $P_8$ relative to $P_{critical}$) with the enthalpy intermediate between the enthalpies of the mixing streams (i.e., $h_7<h_8<h_4$).

From position "8" to position "1": Compression process in the second compressor 48 (in idealized reversible case, isoentropically) from near-critical or supercritical or superheated vapor state "8" at lower pressure $P_8$ to the higher pressure $P_1$ superheated vapor state "1", which is in the supercritical fluid domain.

Please note that the values for $P_1$ through $P_8$, $P_{critical}$, $h_1$ through $h_8$, $h_{critical}$, etc. depend, at least in part, upon the working fluid used.

In general, embodiments of the Vortex VCR system include the following characteristics: (1) maximum pressure (in gas cooler/condenser) for the cycle is greater than the critical pressure of the working fluid (i.e., $P_{max}>P_{critical}$), (2) the minimum pressure of the cycle (in the evaporator) is lower than the critical pressure for the working fluid (i.e., $P_{min}<P_{critical}$), and (3) the minimum pressure and temperature of the cycle (e.g., in the evaporator) are greater than the temperature and pressure in the triple point state of the working fluid (i.e., $P_{min}>P_{triple}$ and $T_{min}>T_{triple}$). However, it should be noted that embodiments of the Vortex VCR system can operate under non-ideal circumstances and still be useful, and are contemplated to be within the scope of this disclosure.

Figure 5:
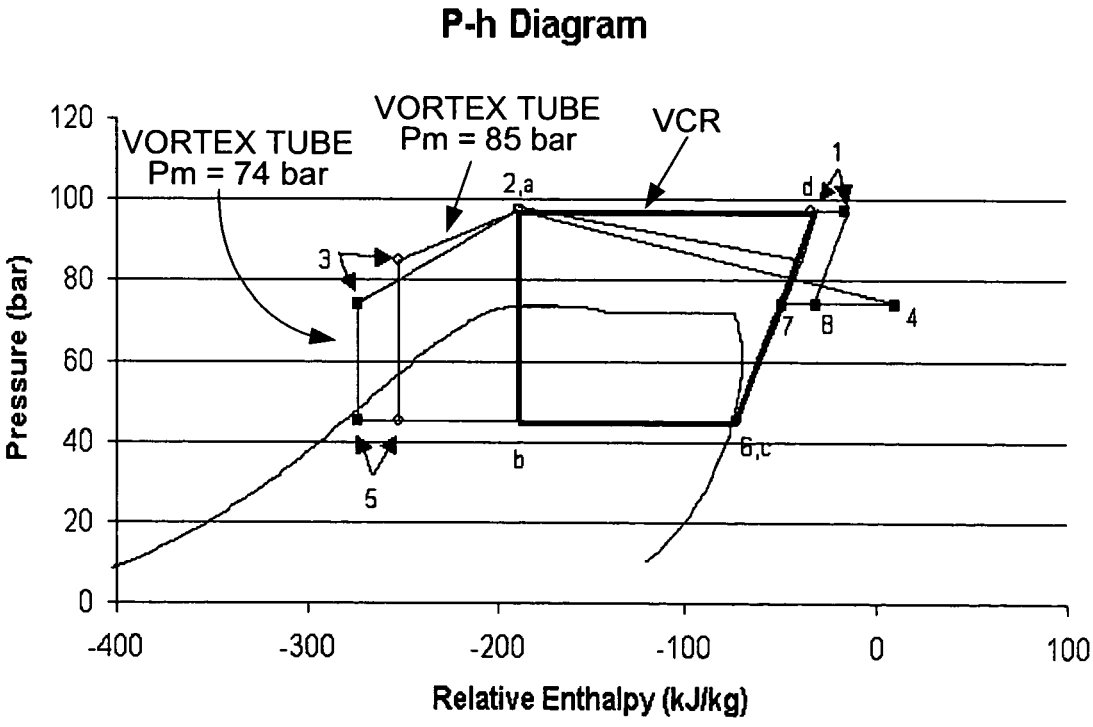
FIG. 5 illustrates a comparison of thermodynamic cycles for conventional transcritical $CO_2$ vapor compression refrigeration and a vortex VCR system, where two vortex VCR cycles with different expansion (pressure drop) ratios (vortex tube exit pressure $P_3=P_m=85$ and 74 bar) across vortex tube are illustrated.

FIG. 5 illustrates a comparison of thermodynamic cycles for conventional transcritical $CO_2$ vapor compression refrigeration and a Vortex VCR system having a vortex tube, where two cycles with different expansion (pressure drop) ratios (defined by the outlet pressure of the vortex tube $P_3=P_m=85$ and 74 bar) across vortex tube are illustrated. It demonstrates that there is an optimal pressure drop across the vortex tube, depending on the specific cycle design, working fluid, and operating conditions, that can be established through thermodynamic optimization analysis in each specific case.

FIG. 6 illustrates the dependence of the coefficient of performance (COP) of the Vortex VCR system incorporating a vortex tube (with 2 compressors) as a function of the outlet pressure (pressure ratio) of the vortex tube. The conventional transcritical $CO_2$ vapor compression refrigeration cycle has COP of 3.1, which is considerably lower than what is obtained when the vortex tube is used in the cycle (COP>3.1, and about 4.5 at $P_3=P_m=76$ bar) even when non-ideal (with losses) compression processes (when considered from positions "6" to position "7" and from position "8" to position "1") are considered. Thus, the Vortex VCR system is on par with the best COPs that currently could be obtained only with environmentally dangerous refrigerants such as R-22 & R-134a. These performance (COP) improvement numbers are case specific and given here when the working fluid is $CO_2$ under exemplary operating pressures and temperatures (as prescribed in FIG. 6). As such, they are used to illustrate the principles and are not intended to be restrictive in any sense. It should be noted that even greater increases in COP could be achieved by the Vortex VCR system under different operating conditions.

Figure 7:
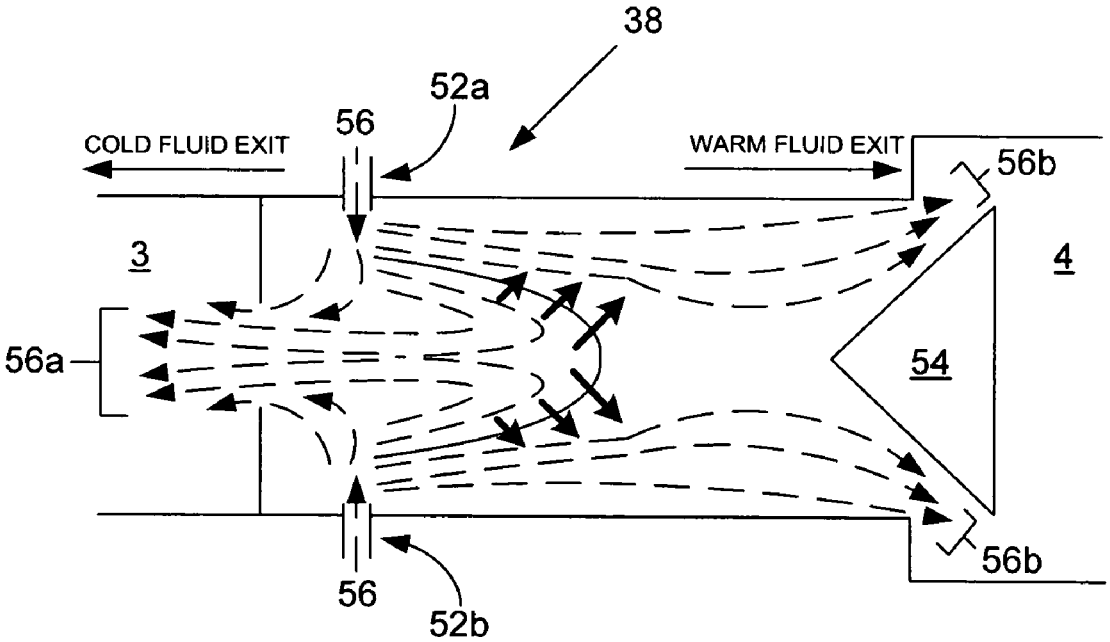
FIG. 7 illustrates an exemplary embodiment of a vortex tube as shown in FIG. 3.

FIG. 7 illustrates an exemplary embodiment of a vortex tube. In particular, FIG. 7 illustrates one possible design and explanation of how a vortex tube operates. It should be noted that the following discussion is one possible explanation of how a vortex tube operates, but the operation of the VCR system is not dependent on the theoretical explanation provided below and one or more other theories may more accurately explain the operation of vortex tubes.

As discussed above, the coupling of a vortex tube 38 with very compressible fluids offers the potential for major increases in energy efficiency of VCR systems 30. The vortex tube 38 is an energy separation device that has no moving parts and is capable of separating a high-pressure flow of a working fluid into two lower pressure streams of working fluid, where the streams leave at different pressures and significantly different temperatures. A schematic of the device is shown in FIG. 7. High-pressure working fluid 56 enters the vortex tube 38 tangentially via gas inlets 52*a* and 52*b* and establishes vortex moving along the vortex tube length. As the working fluid expands and achieves a high tangential velocity in the vortex flow, part of the stream 56*b* (near the periphery of the tube) leaves the vortex tube 38 hot (i.e., with higher enthalpy than the inlet fluid) and flows to position "4". Another part of the stream 56*a* is reflected from the cone 54 at the hot end of the vortex tube 38 and exits near the center of the vortex tube 38 cold (i.e., with lower enthalpy than the inlet fluid) at an opposite end in the vicinity of vortex tube 38 and flows to position "3". By adjusting the pressure ratio between an incoming stream 56 and leaving streams 56*a* and 56*b*, the nature of the working fluid, and design (e.g., length/diameter ratio) of the tube, it is possible to achieve different a degree of temperature (enthalpy) separation.

The vortex tube can have inlet-to-exit pressure ratio between 1 to several hundred bar and an outlet pressure ranging from sub-atmospheric pressures to several tens to hundreds of bar depending on the choice of working fluid, the Vortex VCR cycle design, and required operating temperatures of the cycle.

While embodiments of Vortex VCR system are described in connection with Examples 1 and 2 and the corresponding text and figures, there is no intent to limit embodiments of the Vortex VCR system to these descriptions. On the contrary, the intent is to cover all alternatives, modifications, and equivalents included within the spirit and scope of embodiments of the present disclosure.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range.

EXAMPLE 1

The following example is given to illustrate the performance improvement in COP that can be obtained using Vortex VCR system. The design of transcritical Vortex VCR system is considered for cooling a computer chip dissipating 100 W. The design conditions specify $CO_2$ as a working fluid, the evaporator temperature and pressure of $P_5=P_6=45$ bar and $T_5=10°$ C., respectively, and the gas cooler/condenser pressure and temperature of $P_1=P_2=97$ bar and $T_2=40°$ C., respectively (where the states are defined in FIGS. 4 and 5). With these design parameters, the coefficient of performance of a conventional transcritical carbon dioxide refrigeration cycle with an actual (not isentropic) compressor is about equal to 2.8 only (see straight horizontal line shown in FIG. 6). Whereas, when the Vortex VCR is used to achieve the same 100 W cooling at 10° C., the coefficient of performance is much greater as compared to the conventional transcritical refrigeration cycle without the vortex tube (given by a dome-shaped line on FIG. 6). There is an optimal pressure ratio for the vortex tube (corresponding to the outlet pressure of $P_3$~75 bar for the fixed inlet pressure of $P_2=97$ bar) that leads to the maximum COP approaching 4.5. This best performance is obtained when two compressors are used in the cycle. It should also be mentioned that Vortex VCR operation at less than optimal conditions are still superior to the conventional refrigeration cycle, such as at $P_3$ from about 45-95 bar, about 55-90 bar, about 65-85 bar, about 70-80 bar, and about 72-78 bar. It should also be noted that even if only one compressor (and no throttling) is used, the COP of the Vortex VCR cycle is about 3.1, which is still greater than 2.8 COP of the conventional transcritical cycle.

Although the best methodologies of this disclosure have been particularly described in the foregoing disclosure, it is to be understood that such descriptions have been provided for purposes of illustration only, and that other variations both in form and in detail can be made thereupon by those skilled in the art without departing from the spirit and scope of the present invention, which is defined, in part, by the appended claims.

What is claimed is:

1. A vortex tube assisted vapor compression refrigeration (vortex VCR) system comprising:

at least one vortex tube, an evaporator, a condenser, at least one compressor, a throttle, and a working fluid, wherein the vortex tube, the evaporator, the condenser, the compressor, and the throttle are in fluid communication with one another via a manifold, wherein the vortex tube has a first end and a second end, wherein the vortex tube is configured to separate the working fluid into a first working fluid stream and a second working fluid stream, wherein the vortex tube is configured to direct the first working fluid stream out of the first end of the vortex tube, wherein the vortex tube is configured to direct the second working fluid stream out of the second end of the vortex tube, wherein the manifold is configured to direct the first working fluid stream to the evaporator, wherein the manifold is configured to direct the second working fluid away from the evaporator, wherein the first working fluid stream has a lower enthalpy than the second working fluid stream, wherein the working fluid comprises a $CO_2$ fluid, wherein at least one compressor comprises two compressors, wherein a first compressor is positioned after the evaporator and a second compressor is positioned after the first compressor and before the condenser, wherein the first compressor is configured to receive the first working fluid exiting the evaporator and the second compressor is configured to receive a mixture of the second working fluid stream and the first working fluid stream exiting the first compressor.

2. The vortex VCR system of claim 1, wherein the system is in thermal communication with the evaporator whereby heat is removed from the system, wherein the system is selected from at least one of the following: a semiconductor system, a refrigerator system, a freezer system, an air conditioning system, and a gas liquefaction system.

3. The vortex VCR system of claim 1, wherein the at least one compressor includes one compressor that is configured to receive a mixture of the second working fluid stream and the first working fluid stream exiting the evaporator.

4. The vortex VCR system of claim 1, wherein a coefficient of performance (COP) of the VCR system is increased by including the vortex tube in the vortex VCR system.

5. The vortex VCR system of claim 1, wherein a coefficient of performance (COP) of the VCR system is greater than about 3.3, wherein a maximum and a minimum operating temperature of the cycle is about 40° C. and about 0° C., respectively, and wherein a pressure ratio of the vortex tube is from about 50 to 95 bar.

6. A vortex tube assisted vapor compression refrigeration (vortex VCR) system comprising:

"n" number of a vortex tube, an evaporator, a condenser, "n+1" number of a compressor, and a working fluid, wherein the vortex tube, the evaporator, the condenser, and the compressors, are in fluid communication with one another via a manifold, wherein each vortex tube has a first end and a second end, wherein the vortex tube is configured to separate the working fluid into a first working fluid stream and a second working fluid stream, wherein the vortex tube is configured to direct the first working fluid stream out of the first end of the vortex tube, wherein the vortex tube is configured to direct the second working fluid stream out of the second end of the vortex tube, wherein the first working fluid stream has a lower enthalpy than the second working fluid stream, and wherein "n" is from 1 to 20.

7. The vortex VCR system of claim 6, wherein "n" is equal to 1.

8. The vortex VCR system of claim 6, wherein the working fluid comprises a $CO_2$ fluid.

9. The vortex VCR system of claim 6, wherein the system is in thermal communication with the evaporator whereby heat is removed from the system, wherein the system is selected from at least one of the following: a semiconductor system, a refrigerator system, a freezer system, an air conditioning system, and a gas liquefaction system.

10. The vortex VCR system of claim 6, wherein a coefficient of performance (COP) of the VCR system is increased by including the vortex tube in the vortex VCR system.

11. A method of cooling, comprising, providing a vortex tube assisted vapor compression refrigeration (vortex VCR) system comprising: a vortex tube, an evaporator, a condenser, at least one compressor, a throttle, and a working fluid, wherein the vortex tube, the evaporator, the condenser, the compressor, and the throttle are in fluid communication with one another via a manifold, wherein the first working fluid stream has a lower enthalpy than the second working fluid stream, and wherein the working fluid comprises a $CO_2$ fluid;

flowing the working fluid into the vortex tube, wherein the working fluid is separated into a first working fluid stream and a second working fluid stream by the vortex tube;

flowing the first working fluid stream toward the evaporator and flowing the second working fluid stream away from the evaporator; and wherein the throttle is disposed between the vortex tube and the evaporator, wherein the first working fluid stream flows through the throttle.

12. The method of claim 11, wherein the vortex tube has a first end and a second end, wherein the vortex tube is configured to direct the first working fluid stream out of the first end of the vortex tube, and wherein the vortex tube is configured to direct the second working fluid stream out of the second end of the vortex tube.

13. The method of claim 11, wherein a system is in thermal communication with the evaporator whereby heat is removed from the system, wherein the system is selected from at least one of the following: a semiconductor system, a refrigerator system, a freezer system, an air conditioning system, and a gas liquefaction system.

14. The method of claim 11, wherein a coefficient of performance (COP) of the vortex VCR system is increased.

15. A method of cooling, comprising, providing a vortex tube assisted vapor compression refrigeration (vortex VCR) system comprising: "n" number of a vortex tube, an evaporator, a condenser, "n+1" number of a compressor, and a working fluid, wherein the vortex tube, the evaporator, the condenser, and the compressor, are in fluid communication with one another via a manifold, and wherein "n" is from 1 to 20;

flowing the working fluid into a vortex tube, wherein the working fluid is separated into a first working fluid stream and a second working fluid stream by the vortex tube, wherein the first working fluid stream has a lower enthalpy than the second working fluid stream; and flowing the first working fluid stream out of a first end of the vortex tube and flowing the second working fluid stream out of a second end of the vortex tube, wherein a coefficient of performance (COP) of the vortex VCR system is increased.

16. The method of claim 15, wherein the system is in thermal communication with the evaporator such that heat is removed from the system, wherein the system is selected from at least one of the following: a semiconductor system, a refrigerator system, a freezer system, an air conditioning system, and a gas liquefaction system.

17. The method of claim 15, wherein the working fluid comprises a $CO_2$ fluid.

18. A vortex tube assisted vapor compression refrigeration (vortex VCR) system comprising:

at least one vortex tube, an evaporator, a condenser, at least one compressor, a throttle, and a working fluid, wherein the vortex tube, the evaporator, the condenser, the compressor, and the throttle are in fluid communication with one another via a manifold, wherein the vortex tube has a first end and a second end, wherein the vortex tube is configured to separate the working fluid into a first working fluid stream and a second working fluid stream, wherein the vortex tube is configured to direct the first working fluid stream out of the first end of the vortex tube, wherein the vortex tube is configured to direct the second working fluid stream out of the second end of the vortex tube, wherein the manifold is configured to direct the first working fluid stream to the evaporator, wherein the manifold is configured to direct the second working fluid away from the evaporator, wherein the first working fluid stream has a lower enthalpy than the second working fluid stream, wherein the working fluid comprises a $CO_2$ fluid, wherein a coefficient of performance (COP) of the VCR system is greater than about 3.3, wherein a maximum and a minimum operating temperature of the cycle is about 40° C. and about 0° C., respectively, and wherein a pressure ratio of the vortex tube is from about 50 to 95 bar.

19. The vortex VCR system of claim 18, wherein the system is in thermal communication with the evaporator whereby heat is removed from the system, wherein the system is selected from at least one of the following: a semiconductor system, a refrigerator system, a freezer system, an air conditioning system, and a gas liquefaction system.

20. The vortex VCR system of claim 18, wherein the at least one compressor includes one compressor that is configured to receive a mixture of the second working fluid stream and the first working fluid stream exiting the evaporator.

21. The vortex VCR system of claim 18, wherein a coefficient of performance (COP) of the VCR system is increased by including the vortex tube in the vortex VCR system.

22. A method of cooling, comprising, providing a vortex tube assisted vapor compression refrigeration (vortex VCR) system comprising: a vortex tube, an evaporator, a condenser, at least one compressor, a throttle, and a working fluid, wherein the vortex tube, the evaporator, the condenser, the compressor, and the throttle are in fluid communication with one another via a manifold, wherein the first working fluid stream has a lower enthalpy than the second working fluid stream, and wherein the working fluid comprises a $CO_2$ fluid;

flowing the working fluid into the vortex tube, wherein the working fluid is separated into a first working fluid stream and a second working fluid stream by the vortex tube;

flowing the first working fluid stream toward the evaporator and flowing the second working fluid stream away from the evaporator;

wherein a coefficient of performance (COP) of the VCR system is greater than about 3.3, wherein a maximum and a minimum operating temperature of the cycle is about 40° C. and about 0° C., respectively, and wherein a pressure ratio of the vortex tube is from about 50 to 95 bar.

23. A vortex tube assisted vapor compression refrigeration (vortex VCR) system comprising:

at least one vortex tube, an evaporator, a condenser, at least one compressor, a throttle, and a working fluid, wherein the vortex tube, the evaporator, the condenser, the compressor, and the throttle are in fluid communication with one another via a manifold, wherein the vortex tube has a first end and a second end, wherein the vortex tube is configured to separate the working fluid into a first working fluid stream and a second working fluid stream, wherein the vortex tube is configured to direct the first working fluid stream out of the first end of the vortex tube, wherein the vortex tube is configured to direct the second working fluid stream out of the second end of the vortex tube, wherein the manifold is configured to direct the first working fluid stream to the evaporator, wherein the manifold is configured to direct the second working fluid away from the evaporator, wherein the first working fluid stream has a lower enthalpy than the second working fluid stream, wherein the working fluid comprises a $CO_2$ fluid, and wherein the throttle is disposed between the vortex tube and the evaporator.

24. A vortex tube assisted vapor compression refrigeration (vortex VCR) system comprising: "n" number of a vortex tube, an evaporator, a condenser, "n+1" number of a compressor, a throttle, and a working fluid, wherein the vortex tube, the evaporator, the condenser, the throttle, and the compressors, are in fluid communication with one another via a manifold, wherein each vortex tube has a first end and a second end, wherein the vortex tube is configured to separate the working fluid into a first working fluid stream and a second working fluid stream, wherein the vortex tube is configured to direct the first working fluid stream out of the first end of the vortex tube, wherein the vortex tube is configured to direct the second working fluid stream out of the second end of the vortex tube, wherein the first working fluid stream has a lower enthalpy than the second working fluid stream, wherein "n" is from 1 to 20, and wherein the throttle is disposed between the vortex tube and the evaporator.

25. The vortex VOR system of claim 24, wherein "n" is equal to 1.

26. The vortex VOR system of claim 24, wherein the working fluid comprises a $CO_2$ fluid.

27. The vortex VOR system of claim 24, wherein the system is in thermal communication with the evaporator whereby heat is removed from the system, wherein the system is selected from at least one of the following: a semiconductor system, a refrigerator system, a freezer system, an air conditioning system, and a gas liquefaction system.

28. The vortex VOR system of claim 24, wherein a coefficient of performance (COP) of the VCR system is increased by including the vortex tube in the vortex VCR system.

29. A vortex tube assisted vapor compression refrigeration (vortex VCR) system comprising:

"n" number of a vortex tube, an evaporator, a condenser "n+1" number of a compressor, and a working fluid, wherein the vortex tube, the evaporator, the condenser, and the compressors, are in fluid communication with one another via a manifold, wherein each vortex tube has a first end and a second end, wherein the vortex tube is configured to separate the working fluid into a first working fluid stream and a second working fluid stream, wherein the vortex tube is configured to direct the first working fluid stream out of the first end of the vortex tube, wherein the vortex tube is configured to direct the second working fluid stream out of the second end of the vortex tube, wherein the first working fluid stream has a lower enthalpy than the second working fluid stream, and wherein "n" is from 1 to 20, wherein the system is in thermal communication with the evaporator whereby heat is removed from the system, wherein the system is selected from at least one of the following: a semiconductor system, a refrigerator system, a freezer system, an air conditioning system, and a gas liquefaction system.

30. The vortex VOR system of claim 29, wherein "n" is equal to 1.

31. The vortex VOR system of claim 29, wherein the working fluid comprises a $CO_2$ fluid.

32. A vortex tube assisted vapor compression refrigeration (vortex VCR) system comprising:

"n" number of a vortex tube, an evaporator, a condenser "n+1" number of a compressor, and a working fluid, wherein the vortex tube, the evaporator, the condenser, and the compressors, are in fluid communication with one another via a manifold, wherein each vortex tube has a first end and a second end, wherein the vortex tube is configured to separate the working fluid into a first working fluid stream and a second working fluid stream, wherein the vortex tube is configured to direct the first working fluid stream out of the first end of the vortex tube, wherein the vortex tube is configured to direct the second working fluid stream out of the second end of the vortex tube, wherein the first working fluid stream has a lower enthalpy than the second working fluid stream, wherein "n" is from 1 to 20, wherein a coefficient of performance (COP) of the VCR system is increased by including the vortex tube in the vortex VOR system.

33. The vortex VOR system of claim 32, wherein "n" is equal to 1.

34. The vortex VCR system of claim 32, wherein the working fluid comprises a $CO_2$ fluid.

* * * * *

UNITED STATES PATENT AND TRADEMARK OFFICE

CERTIFICATE OF CORRECTION

PATENT NO. : 7,669,428 B2
APPLICATION NO. : 11/105833
DATED : March 2, 2010
INVENTOR(S) : Fedorov et al.

It is certified that error appears in the above-identified patent and that said Letters Patent is hereby corrected as shown below:

Title Page; Page 1, Paragraph (75): should read;

Inventors: Fedorov; Andrei G. (Atlanta, GA), Wadell; Robert (Atlanta, GA), Launay; Stephane (Atlanta, GA)

Signed and Sealed this

Thirteenth Day of April, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,669,428 B2
APPLICATION NO. : 11/105833
DATED : March 2, 2010
INVENTOR(S) : Fedorov et al.

It is certified that error appears in the above-identified patent and that said Letters Patent is hereby corrected as shown below:

In the Claims:

In claims 25-28 and 30-33, the acronym "VOR" should be replaced with "VCR."

Signed and Sealed this

Eleventh Day of May, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,669,428 B2
APPLICATION NO. : 11/105833
DATED : March 2, 2010
INVENTOR(S) : Fedorov et al.

It is certified that error appears in the above-identified patent and that said Letters Patent is hereby corrected as shown below:

Column 13, Claim 25, line 22, the acronym "VOR" should be replaced with "VCR".

Column 13, Claim 26, line 24, the acronym "VOR" should be replaced with "VCR".

Column 13, Claim 27, line 26, the acronym "VOR" should be replaced with "VCR".

Column 13, Claim 28, line 32, the acronym "VOR" should be replaced with "VCR".

Column 14, Claim 30, line 15, the acronym "VOR" should be replaced with "VCR".

Column 14, Claim 31, line 17, the acronym "VOR" should be replaced with "VCR".

Column 14, Claim 32, line 37, the acronym "VOR" should be replaced with "VCR".

Column 14, Claim 33, line 38, the acronym "VOR" should be replaced with "VCR".

This certificate supersedes the Certificate of Correction issued May 11, 2010.

Signed and Sealed this

Fifteenth Day of June, 2010

David J. Kappos

David J. Kappos
*Director of the United States Patent and Trademark Office*